US009474379B1

(12) United States Patent
Villasuso

(10) Patent No.: US 9,474,379 B1
(45) Date of Patent: Oct. 25, 2016

(54) ERGONOMIC AND ADJUSTABLE END TABLE

(71) Applicant: Carved Woodworks, LLC, Miami, FL (US)

(72) Inventor: Daniel Villasuso, Miami, FL (US)

(73) Assignee: Carved Woodworks, LLC, Miami, FL (US)

( * ) Notice: Subject to any disclaimer, the term of this patent is extended or adjusted under 35 U.S.C. 154(b) by 0 days.

(21) Appl. No.: 14/967,305

(22) Filed: Dec. 12, 2015

(51) Int. Cl.

| | |
|---|---|
| ***A47B 23/00*** | (2006.01) |
| ***A47C 7/68*** | (2006.01) |
| ***A47B 13/16*** | (2006.01) |
| ***A47B 23/02*** | (2006.01) |

(52) U.S. Cl.
CPC ..... *A47C 7/68* (2013.01); *A47B 13/16* (2013.01); *A47B 23/001* (2013.01); *A47B 23/02* (2013.01)

(58) Field of Classification Search
CPC ..... A47C 7/68; A47B 13/16; A47B 23/001; A47B 23/02
USPC ..... 108/47, 46, 49, 42, 25; 297/145, 135
See application file for complete search history.

(56) References Cited

U.S. PATENT DOCUMENTS

| | | | | | |
|---|---|---|---|---|---|
| 2,797,973 | A * | 7/1957 | Culpepper | A47C 7/68 | 108/157.11 |
| 2,867,401 | A * | 1/1959 | Sheahan | A47C 7/68 | 108/47 |
| 3,807,319 | A * | 4/1974 | Steanson, Jr. | A47C 7/62 | 108/42 |
| 4,003,598 | A * | 1/1977 | Glaze | A47C 7/70 | 297/161 |
| 4,301,767 | A * | 11/1981 | Willinger | A01K 63/065 | 119/245 |
| 4,575,149 | A * | 3/1986 | Forestal | A47C 7/68 | 108/135 |
| 5,240,214 | A * | 8/1993 | Birnbaum | A47B 88/044 | 248/214 |
| 5,899,147 | A * | 5/1999 | Clayton | A47B 96/028 | 108/108 |
| 6,082,270 | A * | 7/2000 | Zerger | B60N 3/001 | 108/42 |
| 7,121,213 | B2 * | 10/2006 | Viazanko | A47B 13/08 | 108/42 |
| D728,286 | S * | 5/2015 | Leinberger | D6/705 | |
| 2015/0238012 | A1 * | 8/2015 | Reviel | F16M 13/022 | 108/42 |
| 2015/0245715 | A1 * | 9/2015 | Leinberger | A47C 7/70 | 108/42 |

* cited by examiner

*Primary Examiner* — Jose V Chen
(74) *Attorney, Agent, or Firm* — Christian Sanchelima; Jesus Sanchelima

(57) ABSTRACT

The present disclosure relates to a universal armrest attachment having a top element and a track element, wherein the top element includes a vertical member perpendicularly mounted to a table member, and a horizontal member, wherein the horizontal member comprises parallel mortises/grooves. The track element, on the other hand, comprises a second vertical member and a second horizontal member, wherein the second horizontal member comprises tenons/protrusions that cooperatively slide on the parallel mortises/grooves of the horizontal member of the top element such that distance between the vertical member of the top element and vertical member of the track element can be adjusted based on width of the armrest and then fixed using a screw or similar means, the mortises/grooves and tenons/protrusions being so configured to then wedge against each other, thereby securing the armrest attachment in place.

13 Claims, 6 Drawing Sheets

ERGONOMIC AND ADJUSTABLE END TABLE

BACKGROUND OF THE INVENTION

1. Field of the Invention

The present disclosure relates generally to field of household furniture. In particular, the present disclosure pertains to an adjustable attachment for use as a table or a tray that fits on armrest of a say a sofa.

2. Description of the Related Art

Background description includes information that may be useful in understanding the present invention. It is not an admission that any of the information provided herein is prior art or relevant to the presently claimed invention, or that any publication specifically or implicitly referenced is prior art.

A good part of leisure time of most people is spent relaxing on a sofa or a chair simultaneously performing various leisure activities such as browsing net, watching television, listening to music, entertaining guests and other like activities. During such leisure time, it is usual to use furniture items such as a side table to keep things related to activity being undertaken. These things may be common household and personal electronic items such as laptop, phone, iPad™, TV remote, cups, snacks, and the like.

Therefore, it makes sense to provide an attachment to a sofa or to a chair so that need for an additional item such as a side table is avoided at the same time increasing comfort. Attempts have been made in past to meet this requirement. However, these prior art effort are either suitable for a particular size of arm rest or depend on complicated mechanisms such as spring loaded slides etc. to make the device fit the arm rests of varying widths. Alternatively they are adjustable devices that require considerable time, effort and special tools for adjustments to match width of an arm rest. They are not easy to assemble to begin with and their usage is also complicated.

There is, therefore, a need in the art for an attachment with simple mechanisms to enable it to be quickly adjusted to fit an arm rest of a sofa or a chair without any special tools and skills. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an armrest that is adjustable to cooperate with many different types and sizes of furniture.

It is another object of this invention to provide such an armrest that is ergonomic to use.

It is still another object of the present invention to provide an armrest that includes a cup holder and slots to support various tangible iterms such as electronic devices and/or books.

It is yet another object of this invention to provide such an apparatus that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1A:
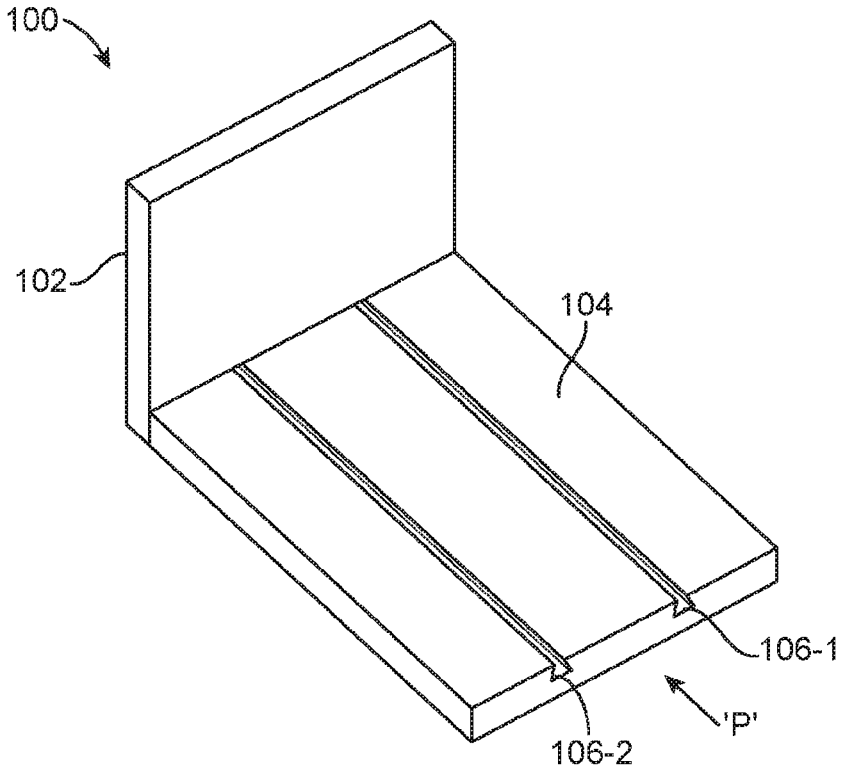
FIG. 1A illustrates an exemplary isometric view of top element of the disclosed attachment in accordance with an embodiment of the present disclosure.

In an exemplary embodiment, the present disclosure relates to an armrest attachable assembly having a top element and a track element, wherein both the top element as well as the track element have vertical and horizontal members that are affixed perpendicularly to each other. In an aspect, the horizontal member of the top element can be configured to hold common household and personal electronic items such as phone, iPad™, TV remote, cups, snacks, and the like; and the two vertical members of the top element and the track element are configured to rest against two vertical sides of the armrest of the sofa.

In an aspect, gap between the two vertical members can be adjusted so as to match width of the arm rest on which the disclosed attachment is to be used wherein the adjustment is continuous and therefore the disclosed attachment can be adjusted for proper fitment on any arm rest irrespective to its width.

In an embodiment, adjustment of the gap between the two vertical members is enabled by providing at least one set of tenon (projection) on one piece that can interlock with corresponding mortise (notch or recess) but enable relative horizontal displacement between the two. In the exemplary embodiment, the tenon and the mortise are dovetail shaped, wherein bottom surface of the horizontal member of the top element incorporates female dovetail shaped mortise/groove/recess, and top surface of the horizontal member of the track element incorporates male dovetail shaped tenon/protrusion/projection. The exemplary embodiment is provided with two sets of tenon and mortise appropriately positioned to facilitate engagement of the top element with the track element.

As would be apparent to a person skilled in art, the mortise/grooves on the bottom surface of the top element and the tenon/protrusions on the top surface of the track element can enable sliding motion between the two while holding them together, thus enabling continuous adjustment of gap between the two vertical members.

In an aspect, there can be means to lock the top element and the track element in a desired position. The means can be a screw through a threaded hole in the horizontal member of the track element configured such that its threaded end tends to project out of the threaded hole when the screw is screwed in and engages with the bottom surface of the horizontal member of the top element. Further tightening of the screw can result in the screw end pushing the two elements apart and resultant wedging of the tenon and the mortise (male and female dovetails) against each other. Such an action, as is apparent, shall lock the two elements together and prevent their relative motion from the desired position.

In an aspect, the desired position of the two elements can be such that gap between the two vertical members is just enough for their insertion on two sides of the arm rest. In such a case, the two vertical members can support the top against tilting, enabling its efficient utilization. Also, the horizontal member of top element can rest on top of an armrest with the two vertical members on its two sides.

In an aspect, the two elements of the attachment can be easily separated wherein separation of the two elements can reduce space required for storage. Dismantling can be done simply by loosening the screw and sliding the top element ant track element apart. Not much effort, time and special tool is required for dismantling the attachment assembly.

Other features of embodiments of the present disclosure will be apparent from accompanying drawings and from detailed description that follows. Embodiments of the present disclosure include various steps and embodiments, which will be described below. If the specification states a component or feature "may", "can", "could", or "might" be included or have a characteristic, that particular component or feature is not required to be included or have the characteristic.

Exemplary embodiments will now be described more fully hereinafter with reference to the accompanying drawings, in which exemplary embodiments are shown. This disclosure may, however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating systems and methods embodying this disclosure. The functions of the various elements shown in the figures may be provided through the use of dedicated hardware as well as hardware capable of executing associated software.

Various terms as used herein are shown below. To the extent a term used in a claim is not defined below, it should be given the broadest definition persons in the pertinent art have given that term as reflected in printed publications and issued patents at the time of filing. An "armrest" as used in the present disclosure means a projection, often padded support for the forearm, as at the side of a chair or sofa or between seats in a theatre, car, or airplane. An embodiment of the present disclosure can include various components as described hereunder.

FIG. 1A illustrates an exemplary isometric view of top element 100 that is the first element of the disclosed attachment incorporating embodiments of the present disclosure.

In an aspect, the top element 100 can include a vertical member 102 that can be permanently fixed with a horizontal member 104 with the two being perpendicular and at right angle to each other. In an aspect, top surface of the horizontal member 104 can serve as holding surface of the disclosed attachment for holding common household and personal electronic items such as phone, laptop, iPad™, TV remote, cups, snacks, and the like.

In another aspect, bottom surface of the horizontal member 104 can incorporate at least one mortise/notch/recess/groove 106 positioned along a direction perpendicular to the vertical member 102. In the exemplary embodiment illustrated in FIG. 1A, two such mortises/notches/recesses/grooves 106-1 and 106-2 have been provided that are parallel to each other. In an embodiment, the at least one groove 106 can be dovetail shaped. However, it is to be understood that any other shape that can engage a corresponding male tenon/projection is well within the scope of the disclosure.

In an embodiment, the vertical member 102 and the horizontal member 104 of the top element 100 can be made of any suitable material including but not limited to wood, plastic, glass, ceramic etc. In another aspect, the vertical member 102 and the horizontal member 104 can be panels of such different materials.

Figure 1B:
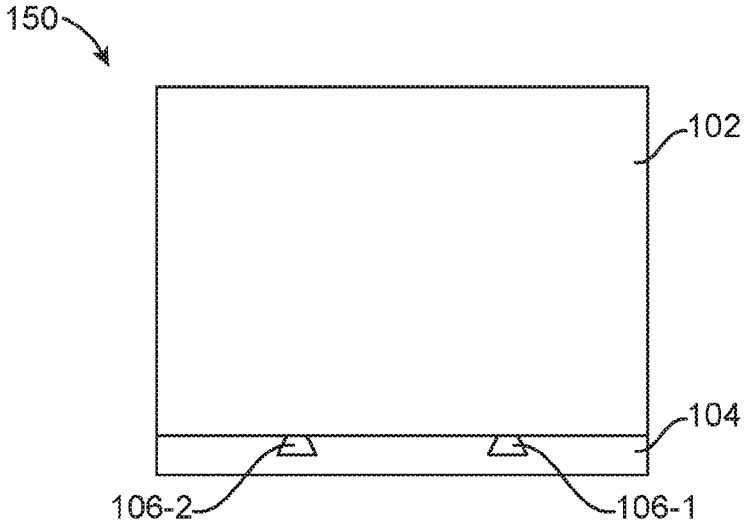
FIG. 1B illustrates an exemplary front view of the top element in accordance with an embodiment of the present disclosure.

FIG. 1B illustrates an exemplary side view of the top element 100 in order to clearly bring out profile of the grooves 106-1 and 106-2. As shown, grooves 106-1 and 106-2 are dovetail shaped configured to accommodate a like shaped tenon/projection configured such that the mortises/grooves and the tenons/protrusions wedge against each other when pulled apart.

Figure 2A:
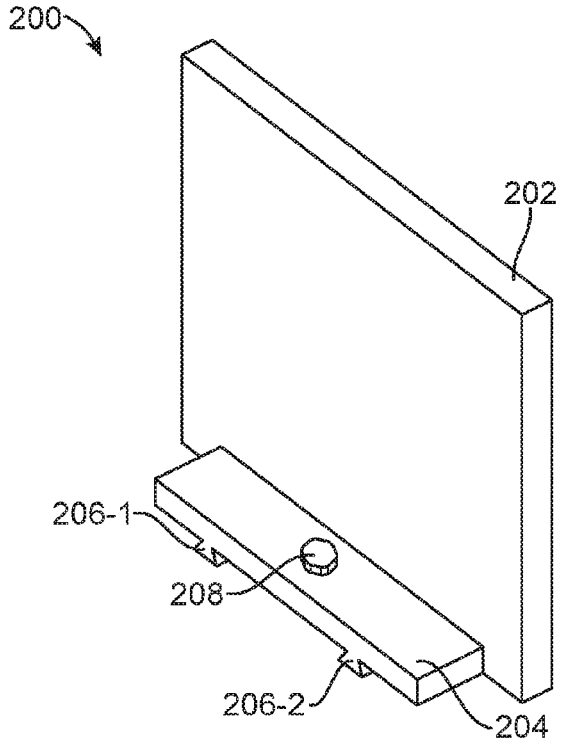
FIG. 2A illustrates an exemplary isometric view of track element of the disclosed attachment in accordance with an embodiment of the present disclosure.
Figure 2B:
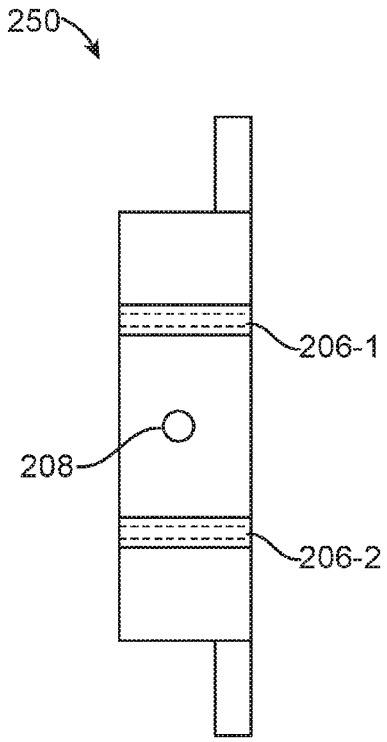
FIG. 2B illustrates an exemplary bottom view of the track element in accordance with an embodiment of the present disclosure.

FIG. 2A and FIG. 2B illustrate exemplary isometric and bottom views of second element of the disclosed attachment that is track element 200 in accordance with an embodiment of the present disclosure. In an aspect, as illustrated in FIG. 2A, the track element 200 can incorporate a second vertical member 202 that can be rigidly fixed with a second horizontal member 204. In yet another aspect, the second horizontal member 204 can incorporate a threaded hole to hold a screw 208.

In another aspect, top surface of the second horizontal member 204 can incorporate at least one tenon/protrusions/projection 206. As shown in FIG. 2B, the at least one tenon/protrusions/projection 206 can be along length of the second horizontal member 204 in a direction perpendicular to the vertical member 202. As in case of top element 100, the exemplary embodiment incorporates two such tenons 206-1 and 206-2 and can be spaced apart so as to match position of the mortises/notches/recesses/grooves 106-1 and 106-2 configured on the top element 100.

Figure 2C:
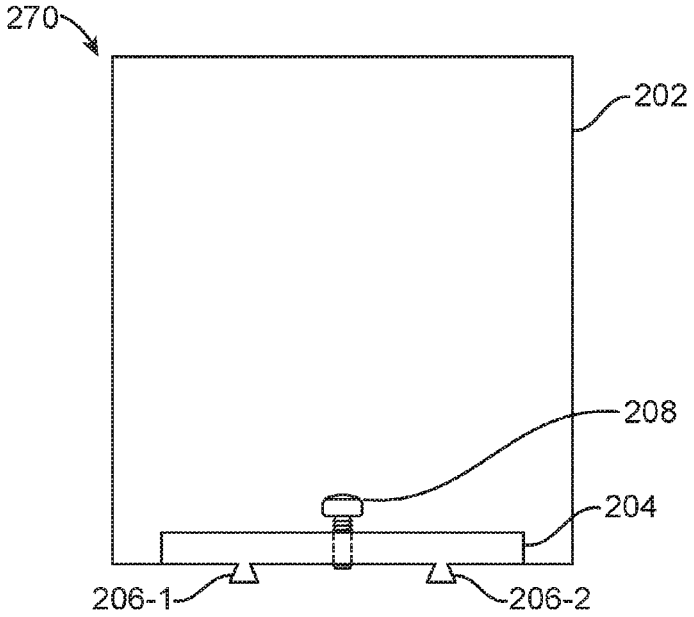
FIG. 2C illustrates an exemplary side view of the track element in accordance with an embodiment of the present disclosure.

FIG. 2C illustrates an exemplary side view of the track element 200 and clearly brings out profile of tenons/protrusions 206-1 and 206-1. As shown, these protrusions can be dovetail shaped matching the mortises/notches/recesses/grooves 106-1 and 106-2. In an aspect, grooves 106-1, 106-2 and protrusions 206-1 and 206-2 can be so configured such that the protrusion 206-1 can slide into the groove 106-1, and the protrusion 206-2 can slide into the groove 106-2, and in the process join the bottom surface of the horizontal member 104 with the top surface of the second horizontal member 204.

In an embodiment, the second vertical member 202 and the second horizontal member 204 can be of any of or a combination of materials such as wood, plastic, glass, ceramic to name a few. In another aspect, element 202 and element 204 can be panels of such different materials.

Figure 3A:
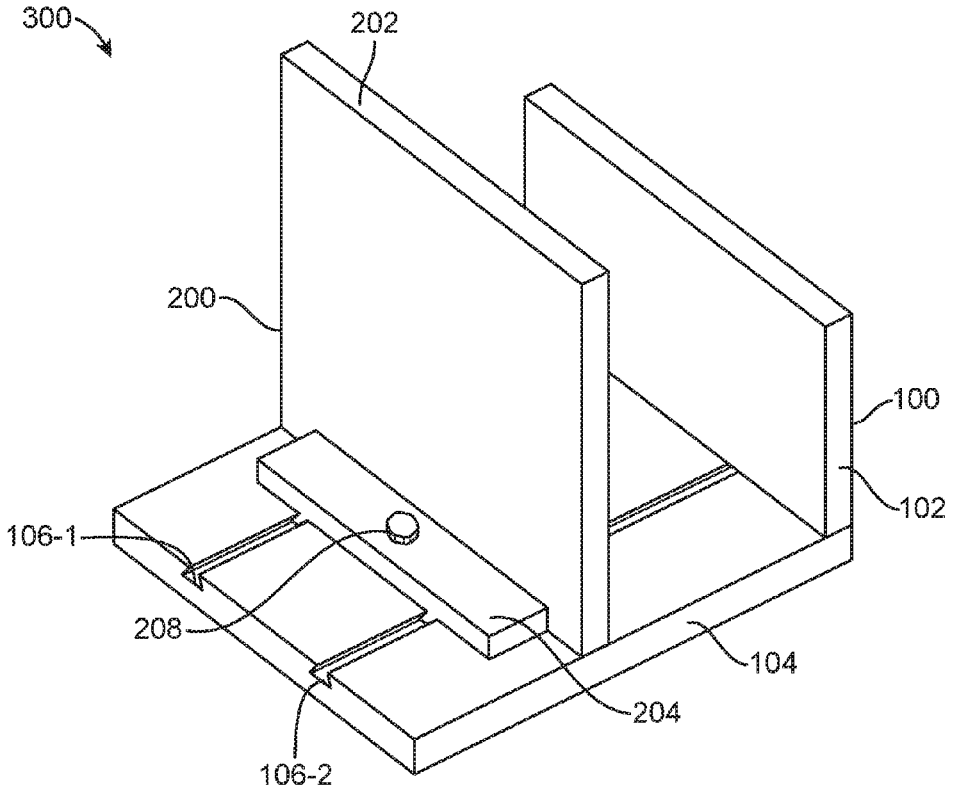
FIG. 3A illustrates an exemplary isometric view of the assembled attachment in accordance with an embodiment of the present disclosure.
Figure 3B:
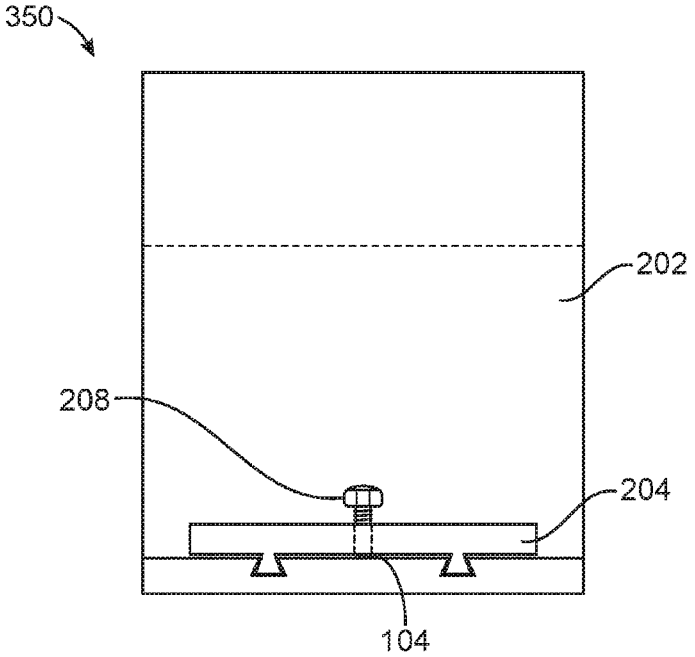
FIG. 3B illustrates an exemplary side view of the assembled attachment in accordance with an embodiment of the present disclosure.

The top element 100 and the track element 200 can be assembled with help of mortises 106 and tenons 206 and moved relative to each other. FIG. 3A and FIG. 3B illustrate exemplary isometric and side views of assembled attachment respectively. As illustrated, second horizontal member 204 can be joined to the horizontal member 104 by sliding protrusions 206-1 and 206-2 (not visible) in the grooves 106-1 and 106-2. At a desired position the two can be clamped by means of screw/bolt 208. As explained earlier tightening of the screw/bolt 208 against the bottom surface of the horizontal member of the top element can cause the tenons and the protrusion to wedge against each other and make the two elements 100 and 200 immovable relative to each other.

To work the proposed attachment, the top element 100 and the track element 200 can be assembled with help of mortises 106 and tenons 206 and moved relative to each other such that gap between the two vertical members 102 and 202 is just enough to place the assembly on the desired arm rest. Thereafter, the screw 208 can be tightened to clamp the two elements together before placing the assembly on the arm rest. In such a position the two vertical members 102 and 202 can support the attachment against tilting by butting against sides of the arm rest thus enabling its efficient utilization. Also, the horizontal member of top element can rest on top of an armrest with the two vertical members on its two sides.

In an aspect, the two elements of the attachment can be easily separated wherein separation of the two elements can reduce space required for storage. Dismantling can be done simply by loosening the screw 208 and sliding the top element ant 100 and track element 200 apart. Not much effort, time and special tool is required for dismantling the attachment assembly.

Figure 4A:
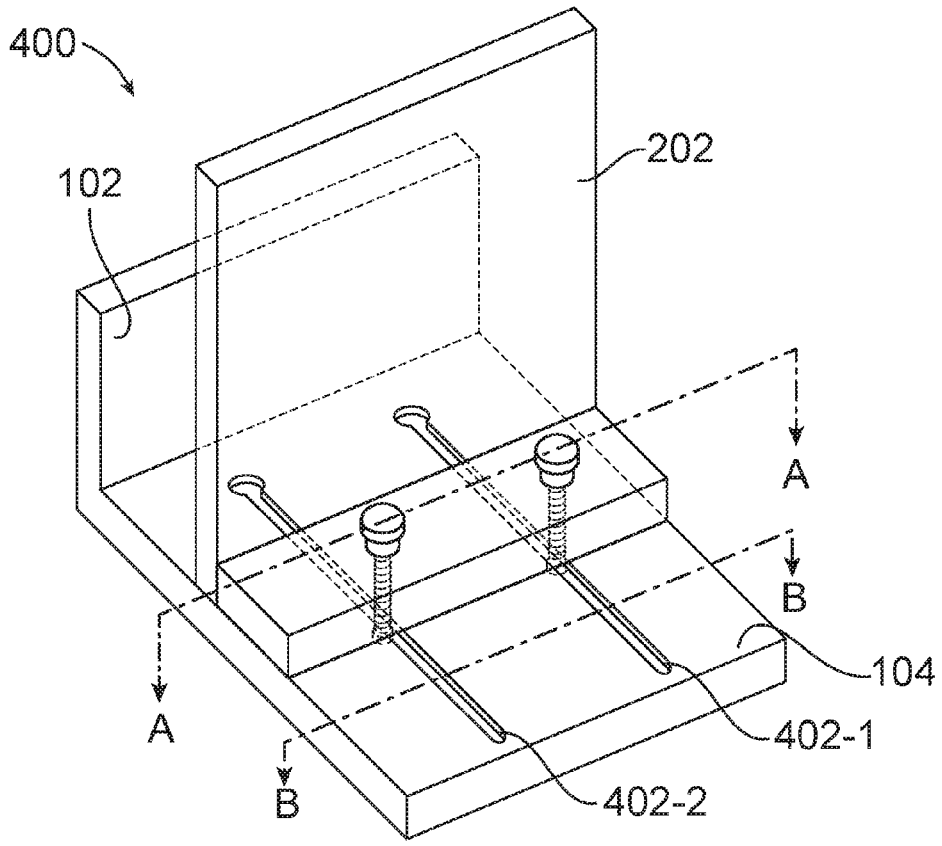
FIG. 4A illustrates an alternate embodiment isometric view of the assembled attachment in accordance with an embodiment of the present disclosure.

FIG. 4A shows an isometric view of an embodiment of the present disclosure, mounted on an armrest. As shown, the armrest is held between second vertical member 202 of track element 200 and the vertical member 102 of top element 100, with top surface of the horizontal member 104 available as a table top or tray.

Figure 5A:
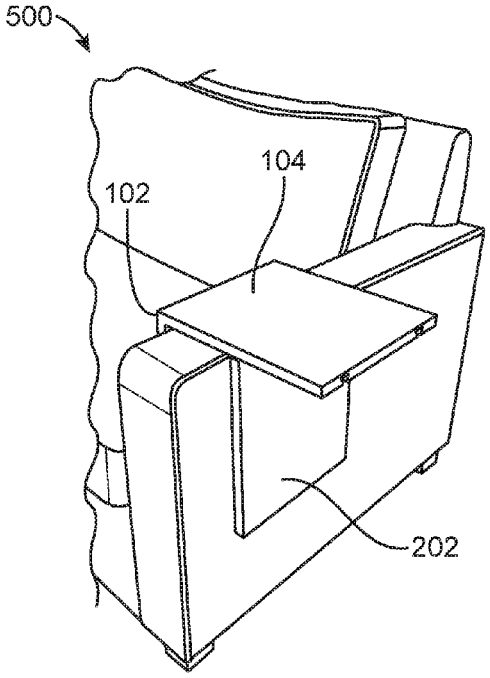
FIG. 5A illustrates an exemplary isometric view of the assembled attachment mounted on an armrest of a sofa in accordance with an embodiment of the present disclosure.
Figure 5B:
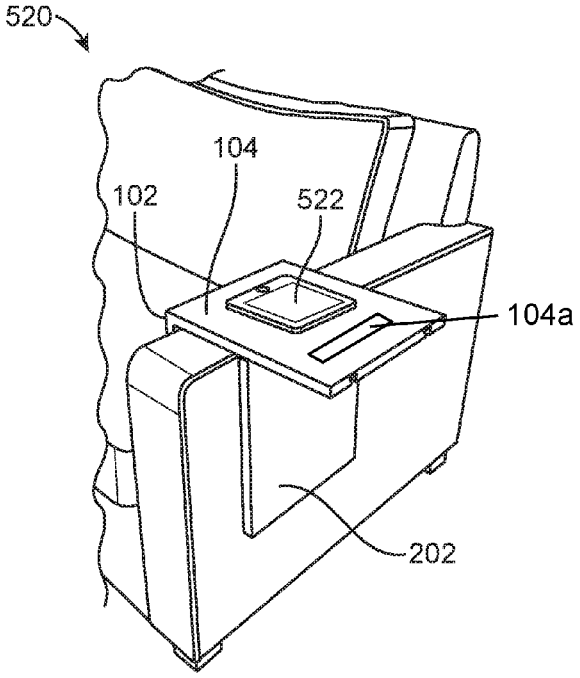
FIG. 5B illustrates an alternate embodiment wherein the armrest table includes a recessed slot 104*a* to support a book or electronic device.
Figure 5C:
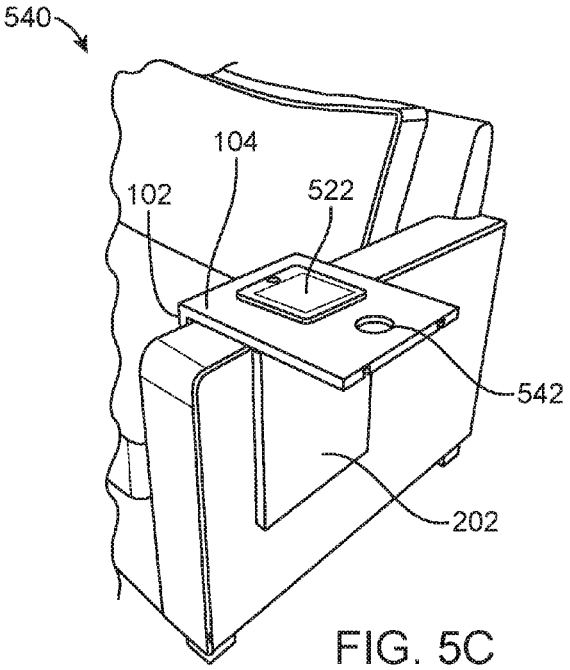
FIG. 5C shows an alternative embodiment wherein the armrest end table includes a cup holder mounted thereon.

In an embodiment, top surface of the horizontal member 104 can be contoured to hold an iPad™ in space 422 as shown in FIG. 5B. In another embodiment, top surface of the horizontal member 104 can have a circular depression/hole 442 to hold a teacup as shown in FIG. 5C. In alternate embodiments, such as the one shown in FIG. 5B, other cavities/gaps/depressions can be made to accommodate one or more defined/desired articles.

In alternate embodiments, attachment assembly as disclosed can easily be used with any furniture that has one or more armrests such as sofa set, couch, armchairs and used to hold household items such as TV remote, phone, glasses, plates, laptops, ipads, magazines etc.

Figure 4B:
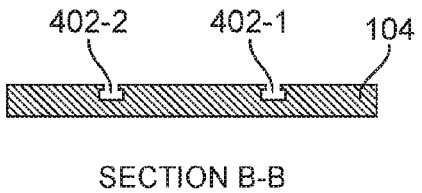
FIG. 4B illustrates a cross-section of the track element showing grooves 402-1 and 402-2.
Figure 4C:
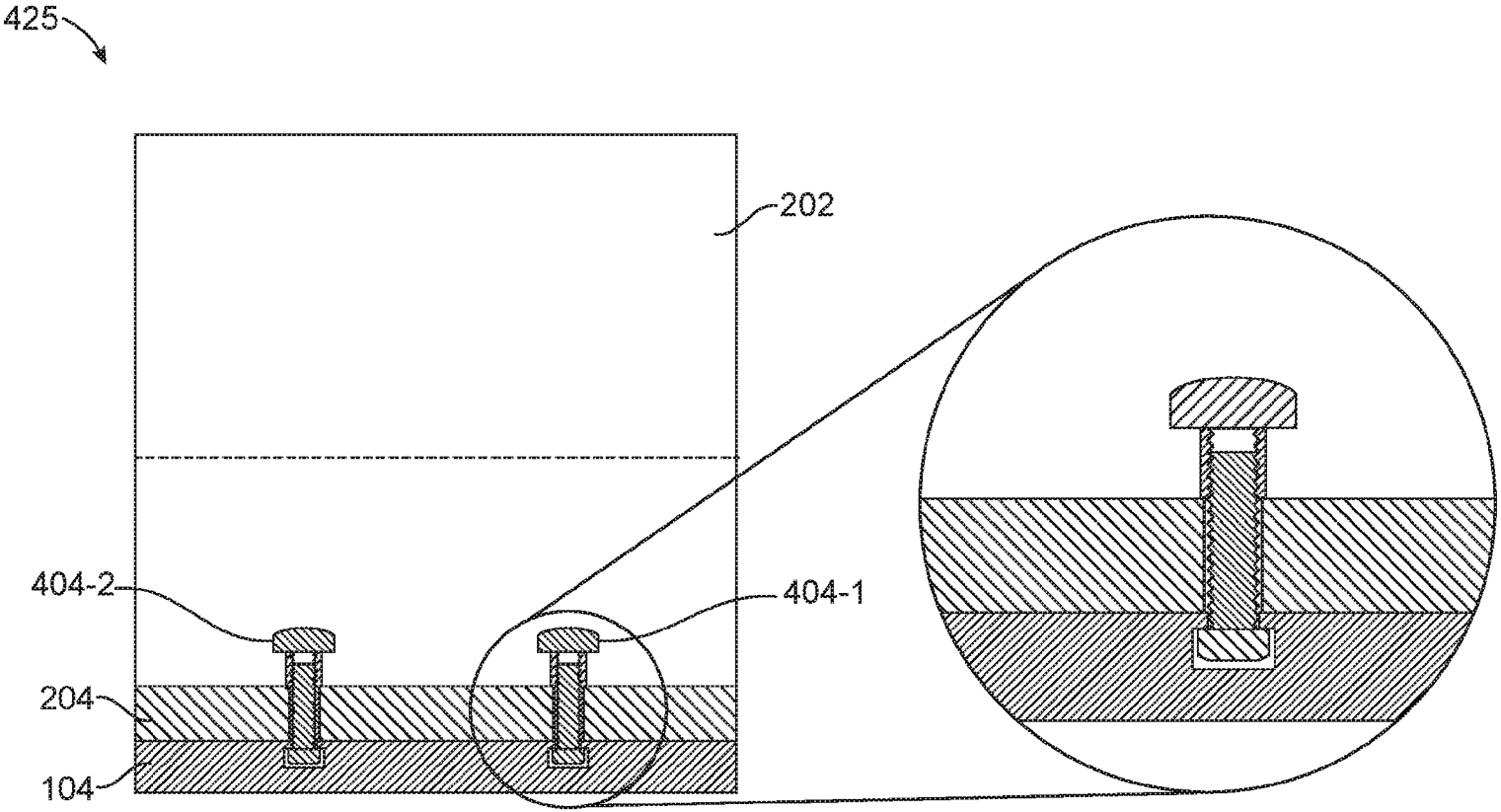
FIG. 4C illustrates a front elevational cross-section view of the track element mounted to the top element with an enlarged front elevational view.

In another alternate embodiment shown in FIGS. 4A-4C, horizontal member 104 can include grooves 402-1 and 402-2 that extend longitudinally and parallel to each other. The end of grooves 402-1 and 402-2 closer to vertical member 102 includes an opening that is wider than the rest of the grooves. The wider opening is configured to cooperatively receive the distal ends of screws 404-1 and 404-2. In this embodiment, horizontal member 204 includes two openings where screws 404-1 and 404-2 are passed through and inserted through the wider openings. Once inserted into the wider openings the screws and the horizontal member 204 can be slid across track element 200 until a user desired location is reached depending on the width of a couch's armrest. Once adjusted to the correct position, screws 404-1 and 404-2 are tightened until they are securely fastened into grooves 402-1 and 402-2, thereby locking vertical members 102 and 202 on opposite sides of the armrest to securely mount the present invention to the furniture.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A furniture end table comprising a unitary, L-shaped top element having a first vertical member rigidly mounted and perpendicular to a first horizontal member, said first horizontal member having a top surface and a bottom surface, said bottom surface including two spaced-apart and continuous grooves positioned along a direction perpendicular to said first vertical member, a track element having a second vertical member rigidly mounted and perpendicular to a second horizontal member, said second horizontal member having two spaced-apart screws and two corresponding threaded holes, said two spaced-apart screws inserted through said two threaded holes and selectively tightened into said two spaced-apart and continuous grooves to slidably mount said second horizontal member to said first horizontal member at any location along said grooves to secure an armrest between said first and second vertical members, thereby locking said end table to said armrest and making said top element and track element immovable relative to each other.

2. The end table subject of claim 1 wherein said bottom surface of said first horizontal member includes two parallel, continuous, and spaced apart grooves located in a direction perpendicular to said first vertical member, said second horizontal member including two screws that cooperate with said two grooves to allow said first and second horizontal members to slide relative to each other.

3. The end table subject of claim 1 wherein said second vertical member and said second horizontal member are made out of wood, plastic, glass, ceramic, or similar material, or any combination thereof.

4. The end table subject of claim 1 wherein said first vertical member and said first horizontal member are made out of wood, plastic, glass, ceramic, or similar material, or any combination thereof.

5. The end table subject of claim 1 wherein said top surface of said first horizontal member includes a depression that cooperates with a cup, thereby acting as a cup holder.

6. The end table subject of claim 1 wherein said top surface of said first horizontal member includes at least one recessed slot, thereby providing a location that can support a book or electronic device.

7. The end table subject of claim 1 wherein said spaced-apart and continuous grooves each include a first and second end, said first ends being closer to said first vertical member and each having openings that are wider than the rest of said grooves.

8. The end table subject of claim 1 wherein said second vertical member is longer than said first vertical member.

9. A furniture end table comprising a unitary, L-shaped top element having a first vertical member rigidly mounted and perpendicular to a first horizontal member, said first horizontal member having a top surface and a bottom surface, said bottom surface including two spaced-apart and continuous grooves positioned along a direction perpendicular to said first vertical member, a track element having a second vertical member rigidly mounted and perpendicular to a second horizontal member, said second horizontal member having a top surface, said top surface having two spaced-apart and unitary protrusions extending therefrom that cooperate with and are wedged into two continuous grooves to slidably mount said second horizontal member to said first horizontal member at any location along said grooves, a threaded hole on said second horizontal member wherein a screw is inserted therethrough, said second horizontal member being selectively slid along said two grooves until a desired position is reached to secure an armrest between said first and second vertical members, said screws being secured into said bottom surface of said first horizontal member grooves when said desired position is reached, said screw being tightened against said bottom surface of said first horizontal member wedging said at least one protrusion into its matching groove, said screw located between said two unitary protrusions, thereby locking said end table to said armrest and making said top element and track element immovable relative to each other.

10. The end table subject of claim 9 wherein said two grooves are dovetail-shaped, each configured to accommodate like-shaped and cooperating projections extending from said top surface of said second horizontal member configured such that said two grooves and said cooperating protrusions wedge against each other when pulled apart, thereby creating a secure engagement between them.

11. The end table subject of claim 9 wherein said second vertical member is longer than said first vertical member.

12. The end table subject of claim 9 wherein said top surface of said first horizontal member includes a depression that cooperates with a cup, thereby acting as a cup holder.

13. The end table subject of claim 9 wherein said top surface of said first horizontal member includes at least one recessed slot, thereby providing a location that can support a book or electronic device.

* * * * *